US008056233B2

(12) United States Patent
Carter et al.

(10) Patent No.: US 8,056,233 B2
(45) Date of Patent: Nov. 15, 2011

(54) METHOD OF MANUFACTURING AN AUTOMOTIVE COMPONENT MEMBER

(75) Inventors: Jon T. Carter, Farmington, MI (US); James G. Schroth, Troy, MI (US); Michael D. Hanna, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1296 days.

(21) Appl. No.: 11/680,179

(22) Filed: Feb. 28, 2007

(65) Prior Publication Data

US 2007/0298275 A1 Dec. 27, 2007

Related U.S. Application Data

(63) Continuation-in-part of application No. 11/475,756, filed on Jun. 27, 2006, now Pat. No. 7,937,819.

(51) Int. Cl.
*B21D 53/88* (2006.01)
*B21D 39/00* (2006.01)

(52) U.S. Cl. ..... 29/897.2; 29/458; 29/527.2; 29/527.3; 29/527.5

(58) Field of Classification Search ..... 29/527.2, 29/527.3, 527.4, 527.5, 530, 458, 460, 897.2; 188/218 XL; 164/98, 112
See application file for complete search history.

(56) References Cited

U.S. PATENT DOCUMENTS

| | | | |
|---|---|---|---|
| 974,024 | A | 10/1910 | Carter |
| 1,484,421 | A | 2/1924 | Thomspon |
| 1,989,211 | A | 1/1935 | Norton |
| 2,012,838 | A | 8/1935 | Tilden |
| 2,026,878 | A | 1/1936 | Farr |
| 2,288,438 | A | 6/1942 | Dach |
| 2,603,316 | A | 7/1952 | Pierce |
| 2,978,793 | A | 4/1961 | Lamson et al. |
| 3,085,391 | A | 4/1963 | Hatfield et al. |
| 3,127,959 | A | 4/1964 | Wengrowski |
| 3,147,828 | A | 9/1964 | Hunsaker |
| 3,292,746 | A | 12/1966 | Robinette |
| 3,378,115 | A | 4/1968 | Stephens, III |
| 3,425,523 | A | 2/1969 | Robinette |
| 3,509,973 | A | 5/1970 | Kimata |

(Continued)

FOREIGN PATENT DOCUMENTS

| | | | |
|---|---|---|---|
| CH | 428319 | A | 1/1967 |

(Continued)

OTHER PUBLICATIONS

International Search Report dated Apr. 2, 2007 for International Application No. PCT US06/29687, Publication No. WO 2007/040768; GM Global Technology Operations, Inc.

(Continued)

*Primary Examiner* — Jermie Cozart
(74) *Attorney, Agent, or Firm* — Reising Ethington P.C.

(57) ABSTRACT

The invention provides a method for manufacturing an automotive component member, including the steps of: (A) positioning at least one insert into a mold, wherein the insert defines a plurality of holes; and (B) casting a portion of the automotive component member in the mold to substantially encapsulate the insert such that a major portion of the insert is substantially non-bonded with the casting material to provide a proper interfacial boundary with the casting material for damping. The method may include the step of coating the insert to prevent bonding between the insert and the casting material. A damped automotive component member having an insert cast therein is also disclosed.

14 Claims, 3 Drawing Sheets

U.S. PATENT DOCUMENTS

| | | | |
|---|---|---|---|
| 3,575,270 | A | 4/1971 | Wagenfuhrer et al. |
| 3,774,472 | A | 11/1973 | Mitchell |
| 3,841,448 | A | 10/1974 | Norton, Jr. |
| 3,975,894 | A | 8/1976 | Suzuki |
| 4,049,085 | A | 9/1977 | Blunier |
| 4,072,219 | A | 2/1978 | Hahm et al. |
| 4,195,713 | A | 4/1980 | Hagbjer et al. |
| 4,250,950 | A | 2/1981 | Buxmann et al. |
| 4,278,153 | A | 7/1981 | Venkatu |
| 4,338,758 | A | 7/1982 | Hagbjer |
| 4,379,501 | A | 4/1983 | Hagiwara et al. |
| 4,475,634 | A | 10/1984 | Flaim et al. |
| 4,523,666 | A | 6/1985 | Murray |
| 4,529,079 | A | 7/1985 | Albertson |
| 4,905,299 | A | 2/1990 | Ferraiuolo et al. |
| 5,004,078 | A | 4/1991 | Oono et al. |
| 5,025,547 | A | 6/1991 | Sheu et al. |
| 5,083,643 | A | 1/1992 | Hummel et al. |
| 5,115,891 | A | 5/1992 | Raitzer et al. |
| 5,139,117 | A | 8/1992 | Melinat |
| 5,143,184 | A | 9/1992 | Snyder et al. |
| 5,183,632 | A | 2/1993 | Kluchi et al. |
| 5,184,663 | A | 2/1993 | Oono |
| 5,259,486 | A | 11/1993 | Deane |
| 5,310,025 | A | 5/1994 | Anderson |
| 5,416,962 | A | 5/1995 | Passarella |
| 5,417,313 | A | 5/1995 | Matsuzaki et al. |
| 5,509,510 | A | 4/1996 | Ihm |
| 5,530,213 | A | 6/1996 | Hartsock et al. |
| 5,582,231 | A | 12/1996 | Siak et al. |
| 5,620,042 | A | 4/1997 | Ihm |
| 5,660,251 | A | 8/1997 | Nishizawa et al. |
| 5,789,066 | A | 8/1998 | DeMare et al. |
| 5,819,882 | A | 10/1998 | Reynolds et al. |
| 5,855,257 | A | 1/1999 | Wickert et al. |
| 5,862,892 | A | 1/1999 | Conley |
| 5,878,843 | A | 3/1999 | Saum |
| 5,927,447 | A | 7/1999 | Dickerson |
| 5,965,249 | A | 10/1999 | Sutton et al. |
| 6,047,794 | A | 4/2000 | Nishizawa |
| 6,073,735 | A | 6/2000 | Botsch et al. |
| 6,112,865 | A | 9/2000 | Wickert et al. |
| 6,206,150 | B1 | 3/2001 | Hill |
| 6,216,827 | B1 | 4/2001 | Ichiba et al. |
| 6,223,866 | B1 | 5/2001 | Giacomazza |
| 6,231,456 | B1 | 5/2001 | Rennie et al. |
| 6,241,055 | B1 | 6/2001 | Daudi |
| 6,241,056 | B1 | 6/2001 | Cullen et al. |
| 6,283,258 | B1 | 9/2001 | Chen et al. |
| 6,302,246 | B1 | 10/2001 | Naumann et al. |
| 6,357,557 | B1 | 3/2002 | DiPonio |
| 6,405,839 | B1 | 6/2002 | Ballinger et al. |
| 6,465,110 | B1 | 10/2002 | Boss et al. |
| 6,481,545 | B1 | 11/2002 | Yano et al. |
| 6,505,716 | B1 | 1/2003 | Daudi et al. |
| 6,507,716 | B2 | 1/2003 | Nomura et al. |
| 6,543,518 | B1 | 4/2003 | Bend et al. |
| 6,648,055 | B1 | 11/2003 | Haug et al. |
| 6,799,664 | B1 | 10/2004 | Connolly |
| 6,880,681 | B2 | 4/2005 | Koizumi et al. |
| 6,890,218 | B2 | 5/2005 | Patwardhan et al. |
| 6,899,158 | B2 | 5/2005 | Matuura et al. |
| 6,932,917 | B2 | 8/2005 | Golden et al. |
| 6,945,309 | B2 | 9/2005 | Frait et al. |
| 7,066,235 | B2 | 6/2006 | Huang |
| 7,112,749 | B2 | 9/2006 | DiPaola et al. |
| 7,178,795 | B2 | 2/2007 | Huprikar et al. |
| 7,293,755 | B2 | 11/2007 | Miyahara et al. |
| 7,594,568 | B2 | 9/2009 | Hanna et al. |
| 7,604,098 | B2 | 10/2009 | Dessouki et al. |
| 7,644,750 | B2 * | 1/2010 | Schroth et al. ..... 164/100 |
| 7,775,332 | B2 | 8/2010 | Hanna et al. |
| 7,836,938 | B2 | 11/2010 | Agarwal et al. |
| 2002/0084156 | A1 | 7/2002 | Ballinger et al. |
| 2002/0104721 | A1 | 8/2002 | Schaus et al. |
| 2003/0037999 | A1 | 2/2003 | Tanaka et al. |
| 2003/0127297 | A1 | 7/2003 | Smith et al. |
| 2003/0141154 | A1 | 7/2003 | Rancourt et al. |
| 2003/0213658 | A1 | 11/2003 | Baba |
| 2004/0031581 | A1 | 2/2004 | Herreid et al. |
| 2004/0045692 | A1 | 3/2004 | Redemske |
| 2004/0074712 | A1 | 4/2004 | Quaglia et al. |
| 2004/0084260 | A1 | 5/2004 | Hoyte et al. |
| 2004/0242363 | A1 | 12/2004 | Kohno et al. |
| 2005/0011628 | A1 | 1/2005 | Frait et al. |
| 2005/0150222 | A1 | 7/2005 | Kalish et al. |
| 2005/0183909 | A1 | 8/2005 | Rau, III et al. |
| 2005/0193976 | A1 | 9/2005 | Suzuki et al. |
| 2006/0076200 | A1 | 4/2006 | Dessouki et al. |
| 2006/0243547 | A1 | 11/2006 | Keller |
| 2007/0039710 | A1 | 2/2007 | Newcomb |
| 2007/0056815 | A1 | 3/2007 | Hanna et al. |
| 2007/0062664 | A1 | 3/2007 | Schroth et al. |
| 2007/0062768 | A1 | 3/2007 | Hanna et al. |
| 2007/0142149 | A1 | 6/2007 | Kleber |
| 2007/0166425 | A1 | 7/2007 | Utsugi |
| 2007/0235270 | A1 | 10/2007 | Miskinis et al. |
| 2007/0298275 | A1 | 12/2007 | Carter et al. |
| 2008/0099289 | A1 | 5/2008 | Hanna et al. |
| 2008/0185249 | A1 | 8/2008 | Schroth et al. |
| 2009/0032569 | A1 | 2/2009 | Sachdev et al. |
| 2009/0107787 | A1 | 4/2009 | Walker et al. |

FOREIGN PATENT DOCUMENTS

| | | | |
|---|---|---|---|
| CN | 20051113784 | A | 10/2005 |
| CN | 1757948 | A | 4/2006 |
| CN | 2863313 | Y | 1/2007 |
| DE | 2446938 | A1 | 4/1976 |
| DE | 2537038 | A1 | 3/1977 |
| DE | 19649919 | A1 | 6/1998 |
| DE | 19948009 | C1 | 3/2001 |
| DE | 60000008 | T2 | 3/2002 |
| DE | 10141698 | A1 | 3/2003 |
| DE | 102005048258 | A1 | 4/2006 |
| DE | 60116780 | T2 | 11/2006 |
| EP | 0205713 | A1 | 12/1986 |
| GB | 1230274 | | 4/1971 |
| GB | 2328952 | | 3/1999 |
| JP | 57154533 | A | 9/1982 |
| JP | 1126434 | U1 | 8/1989 |
| JP | 05-104567 | | 4/1993 |
| JP | 11342461 | A | 12/1999 |
| JP | 2003214465 | A | 7/2003 |
| JP | 2004011841 | A | 1/2004 |
| KR | 20010049837 | A | 6/2001 |
| WO | 9823877 | A1 | 6/1998 |
| WO | 0136836 | A1 | 5/2001 |
| WO | 2007035206 | A2 | 3/2007 |

OTHER PUBLICATIONS

Dessouki et al., U.S. Appl. No. 10/961,813, Coulumb friction damped disc brake rotors, filed Oct. 8, 2004.

Hanna et al., U.S. Appl. No. 11/475,756, Bi-metal disc brake rotor and method of manufacturing, filed Jun. 27, 2006.

Schroth et al., U.S. Appl. No. 11/475,759, Method of casting components with inserts for noise reduction, filed Jun. 27, 2006.

Schroth et al., U.S. Appl. No. 12/025,967, Damped products and methods of making and using the same, filed Feb. 5, 2008.

Hanna et al., U.S. Appl. No. 11/440,916, Bi-metal disc brake rotor and method of manufacture, filed May 25, 2006.

Hanna et al., U.S. Appl. No. 11/554,234, Coulomb damped disc brake rotor and method of manufacturing, filed Oct. 30, 2006.

Walker et al., U.S. Appl. No. 11/926,798, Inserts with holes for damped products and methods of making and using the same, filed Oct. 29, 2007.

Hanna et al., U.S. Appl. No. 11/832,401, Damped product with insert and method of making the same, filed Aug. 1, 2007.

Kleber, et al., U.S. Appl. No. 11/848,732, Cast-in-place torsion joint, filed Aug. 31, 2007.

Hanna et al., U.S. Appl. No. 11/780,679, Method of manufacturing a damped part, filed Jul. 20, 2007.

Aase et al., U.S. Appl. No. 11/969,259, Method of forming casting with frictional damping insert, filed Jan. 4, 2008.

Hanna et al., U.S. Appl. No. 12/165,729, Method for securing an insert in the manufacture of a damped part, filed Jul. 1, 2008.

Hanna et al., U.S. Appl. No. 12/165,731, Product with metallic foam and method of manufacturing the same, filed Jul. 1, 2008.
Agarwal et al., U.S. Appl. No. 11/860,049, Insert with tabs and damped products and methods of making the same, filed Sep. 24, 2007.
Hanna et al., U.S. Appl. No. 12/174,163, Damped part, filed Jul. 16, 2008.
Hanna et al., U.S. Appl. No. 12/174,223, Method of casting damped part with insert, filed Jul. 16, 2008.
Hanna et al., U.S. Appl. No. 12/183,180, Casting noise-damped, vented brake rotors with embedded inserts, filed Jul. 31, 2008.
Hanna et al., U.S. Appl. No. 12/183,104, Low mass multi-piece sound damped article, filed Jul. 31, 2008.
Golden et al., U.S. Appl. No. 12/105,411, Insert with filler to dampen vibrating components, filed Apr. 18, 2008.
Hanna et al., U.S. Appl. No. 11/440,893, Rotor assembly and method, filed May 25, 2006.
Ulicny et al., U.S. Appl. No. 12/105,438, Filler material to dampen vibrating components, filed Apr. 18, 2008.
Hanna et al., U.S. Appl. No. 12/272,164, Surface configurations for damping inserts, filed Nov. 17, 2008.
Hanna et al., U.S. Appl. No. 12/145,169, Damped product with an insert having a layer including graphite thereon and methods of making and using the same, filed Jun. 24, 2008.
Lowe et al., U.S. Appl. No. 12/174,320, Damped part with insert, filed Jul. 16, 2008.
Dessouki et al., U.S. Appl. No. 12/178,872, Friction damped brake drum, filed Jul. 24, 2008.
Sachdev et al., U.S. Appl. No. 11/832,356, Friction welding method and products made using the same, filed Aug. 1, 2007.
Chinese First Office Action; CN200510113784.X; Dated May 18, 2007; 19 pages.
Chinese Second Office Action; CN200510113784.X; Dated Feb. 15, 2008; 13 pages.
German Examination Report; DE102005048258.9-12; Dated Oct. 22, 2007; 8 pages.
Gerdemann, Steven J,; Titanium Process Technologies; Advanced Materials & Processes, Jul. 2001, pp. 41-43.
Mahoney, M. W. & Lynch S. P.; Friction-Stir Processing; 15 pages.
MPIF: All You Need to Know about Powder Metallurgy.
Powder Metallurgy—Wikipedia article; http://en.wikipedia.org/wiki/Powder_metallurgy; 5 pages.
Sintering—Wikipedia article; http://en.wikipedia,org/wiki/Sintering; 2 pages.
Magnetorheological fluid—Wikipedia article.
PCT/US2008/087354 Written Opinion and Search Report; Date of Mailing: Aug. 3, 2009; 9 pages.
PCT/US2009/039839 Written Opinion and Search Report; Date of Mailing: Nov. 24, 2009; 7 pages.
PCT/US2009/048424 Written Opinion and Search Report; Date of Mailing; Dec. 28, 2009; 7 pages.
U.S. Appl. No. 12/328,989, filed Dec. 5, 2008; First Named Inventor: Patrick J. Monsere.
U.S. Appl. No. 12/420,259, filed Apr. 8, 2009; First Named Inventor: Michael D. Hanna.
U.S. Appl. No. 12/434,057, filed May 1, 2009; First Named Inventor: Chongmin Kim.
U.S. Appl. No. 12/436,830, filed May 7, 2009; First Named Inventor: James G. Schroth.
U.S. Appl. No. 12/489,901, filed Jun. 23, 2009; First Named Inventor: Michael D. Hanna.
U.S. Appl. No. 12/885,813, filed Sep. 20, 2010; First Names Inventor: Michael D. Hanna.

* cited by examiner

METHOD OF MANUFACTURING AN AUTOMOTIVE COMPONENT MEMBER

CROSS-REFERENCE TO RELATED APPLICATIONS

This application is a continuation-in-part of U.S. patent application Ser. No. 11/475,756, filed Jun. 27, 2006, now U.S. Pat. No. 7,937,819 B2 which is hereby incorporated by reference in its entirety.

TECHNICAL FIELD

The present invention relates to a cast automotive component and method for damping vehicle noise by casting coulomb damper inserts into an automotive component to provide noise-damping interfaces within the cast automotive components.

BACKGROUND OF THE INVENTION

Vehicle noise, such as that emanating from the powertrain or braking system, transmitted to the passenger compartment of the vehicle contributes to operator and passenger discomfort as well as discomfort to those outside the passenger compartment of the vehicle. In an effort to reduce the transmission of noise from components of the vehicle to the passenger compartment, a variety of techniques have been employed, including the use of polymer coatings, sound absorbing barriers, and laminated panels having viscoelastic layers. Other noise reducing efforts have included the use of noise reducing engine mount designs, including active engine mounts that employ magneto-rheological fluid actuators. While existing noise reducing efforts may have a positive effect on reducing the transmission of noise to the passenger compartment, there remains a need in the art to address the problem associated with the source of the noise. Accordingly, there is a need in the art for alternate methods to damp vehicle noise.

SUMMARY OF THE INVENTION

The invention provides a method for manufacturing a damped automotive component member, including the steps of: (A) positioning at least one insert into a mold; and (B) casting the automotive component member in the mold around the insert such that a major portion of the insert is substantially non-bonded with the casting material to provide a proper interfacial boundary with the casting material for the damping of noise.

The insert may include tabs which support the insert in a suspended position within a mold for casting or may be self supporting or fixturing. The insert preferably also defines a plurality of holes. The insert may be provided with a coating to allow the insert to remain non-bonded with the casting material. Alternately, the non-bonded nature of the insert may arise from the intrinsic properties of the insert itself.

The invention has been demonstrated for grey iron cast around a steel insert, however, a similar effect should be obtained if an insert is cast into aluminum, magnesium, or other suitable materials. Like the cast iron/steel insert arrangement, adhesion of the cast structure to the insert must be avoided by use of a barrier coating, or by selection of an insert material that is not bondable to the casting material. An aluminum insert could be used instead of steel, as long as it has a higher melting point than the cast metal.

The invention may be applicable to many automotive component members, such as brake components, steering knuckles, control arms, cast cradles, cast instrument panel beams, brakes, or any structural or closure casting. Additionally, the invention may benefit traction drive motors for hybrid electric and pure electric propulsion systems, as well as containment/housings for high voltage contactors. Other potential applications include any structure which produces or transmits audible and objectionable noise in service, such as manufacturing machines, railroad equipment, passenger planes, etc. The invention seems particularly well suited for powertrain components which house or enclose one or more rotating, noise-generating components of a vehicle powertrain.

These and additional features and advantages of the present invention will become more clear from the following detailed description of the preferred embodiments.

DESCRIPTION OF THE PREFERRED EMBODIMENTS

The invention provides a method for manufacturing an automotive component member, including the steps of: (A) positioning at least one coulomb damper insert into a mold, wherein the coulomb damper insert defines a plurality of holes; and (B) casting a wall of the automotive component member in the mold around the coulomb damper insert such that a major portion of the coulomb damper insert is substantially non-bonded with the casting material to provide a proper interfacial boundary with the casting material for damping.

Figure 1A:
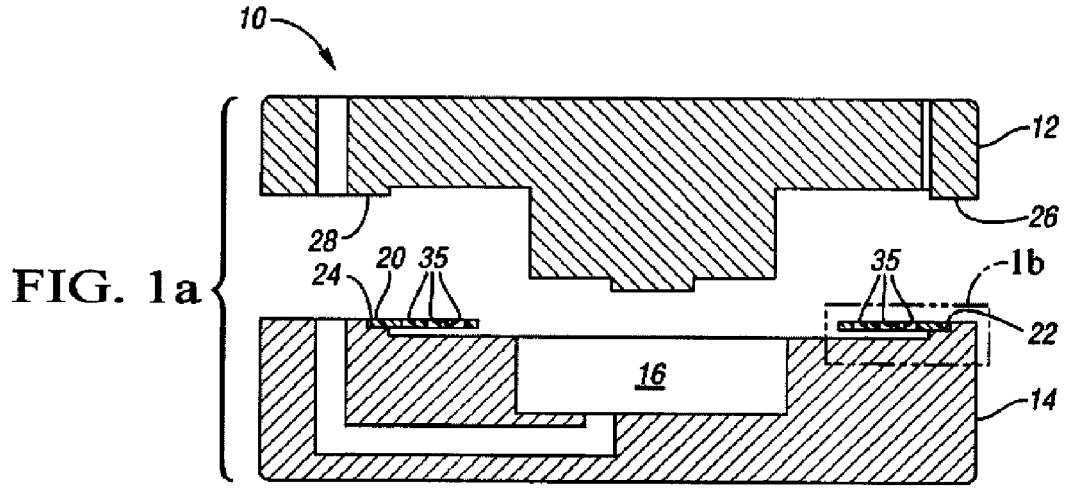
FIG. 1*a* is a schematic cross sectional side view of a coulomb damper insert positioned within a casting mold in accordance with the present invention.
Figure 1B:
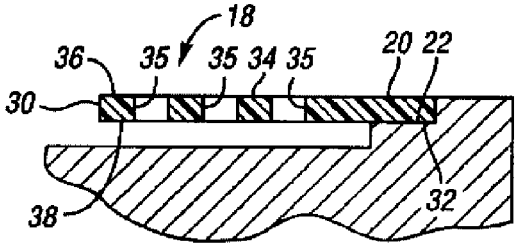
FIG. 1*b* shows an enlarged view of area 1*b* identified in FIG. 1*a* by phantom lines.
Figure 1C:
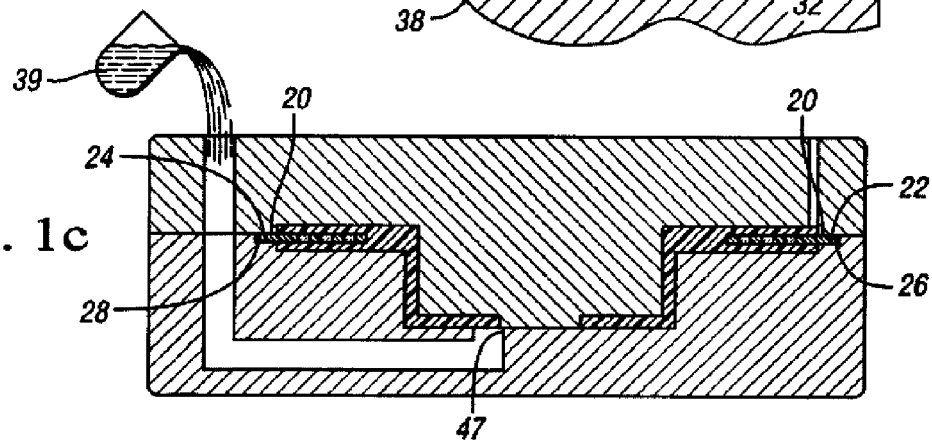
FIG. 1*c* is a schematic cross sectional side view of the mold and coulomb damper insert of FIG. 1*a*, with the mold closed and molten material introduced into the mold to form a coulomb damped disc brake rotor in accordance with the invention.

Referring to FIGS. 1*a* and 1*b*, a mold 10 is provided in accordance with the invention having upper and lower mold halves 12, 14 that form a cavity 16 therebetween for casting a friction or coulomb damped disc brake rotor in accordance with the invention. FIG. 1*b* shows a portion of a coulomb damper insert 18, highlighted in FIG. 1*a* by phantom lines, which is pre-positioned within the mold 10 and having tabs 20 which rest on cutout portions 22, 24 of the lower mold half 14. As shown in FIG. 1*c*, when the upper and lower mold halves 12, 14 are closed together, the tabs 20 are supported between the cutout portions 22, 24 of the lower mold half 14 and the lands 26, 28, respectively of the upper mold half 12.

The coulomb damper insert 18 has a generally annular body 30 with tabs 20 extending generally radially therefrom. Each tab 20 includes a distal portion 32 and a proximal portion 34. During casting, the distal portion 32 is secured between the cutout portions 22, 24 and the lands 26, 28, respectively, shown in FIG. 1*c*, while the proximal portion 34 of each tab 20 is exposed to molten casting material 39 within the mold cavity 16. The body 30 of the coulomb damped insert 18 defines a plurality of orifices or holes 35. Those skilled in the art will recognize that the holes 35 may be any shape, such as circular, diamond, rectangular, triangular, etc, and any size while remaining within the scope of that which is claimed. While it is envisioned that the coulomb damper insert 18 is formed from sheet stock having the holes 35 punched, drilled or otherwise machined therein; those skilled in the art will recognize other materials such as expanded metal, flattened expanded metal, woven screen, wire welded screen, etc. may be used to form the insert 18 while remaining within the scope of that which is claimed.

The mold 10 is preferably formed from sand, and the coulomb damper insert 18 is preferably a pre-manufactured steel component having a coating on opposing surfaces 36, 38 (shown in FIG. 1*b*) of the generally annular body 30 and optionally on the walls defining the holes 35. These coated surfaces 36, 38 do not bond with the casting material 39 during the casting operation, shown in FIG. 1*c*. The lack of affinity along these coated surfaces 36, 38 produces the unbonded interfacial boundary between the generally annular body 30 and a rotor cheek 44, shown in FIG. 1*d*, desired for damping effectiveness. The walls defining the holes 35 may be coated to increase the surface area of the non-bonded portion of the coulomb damper insert 18, thereby increasing damping effectiveness of the coulomb damper insert 18. Optionally, the tabs 20, particularly the proximal portion 34 of each tab 20, may be configured in a manner to bond with the casting material 39 forming the rotor cheek 44 of a coulomb damped disc brake rotor 40 of FIG. 1*d*.

Since the coated surfaces 36, 38 of the coulomb damper insert 18 do not bond with the casting material 39 of the rotor cheek 44, a proper interfacial boundary is formed with the rotor cheek 44 for damping. However, the bonding of the tabs 20, particularly the proximal portions 34 thereof, with the casting material 39 of the rotor cheek 44 prevents corrosion causing exterior elements, such as water and salt, from reaching the interfacial boundary between the coulomb damper insert 18 and the rotor cheek 44. A graphite coating or similar fluxing agent may be applied to the tabs 20 to enhance bonding with the casting material 39. The coulomb damper insert 18 may be formed from any material having a melting point higher than that of casting material 39, such that the coulomb damper insert 18 will not be melted during the casting process. In the preferred embodiment of the coulomb damped disc brake rotor 40, the casting material 39 is iron and, as mentioned hereinabove, the coulomb damper insert 18 is formed from steel.

To apply the coating, the above-referenced coated surfaces 36, 38 must first be cleaned free of oil, rust or dirt. Degreasers may be used to remove thin films of oil, and steel wool may be used to remove rust. The best results are attained when the coulomb damper insert 18 is sand blasted, which removes both oil and rust. It also roughens the surface, which promotes adherence of the coating. A preferred coating material is a ceramic mold wash sold under the trade name IronKote, and is available from Vesuvius Canada Refractories, Inc. of Welland, Ontario. IronKote has alumina and silica particles mixed with an organic binder. It is approximately 47.5% alumina and 39.8% silica with a lignisole (lignosulfanate) binder. The coating preferably has a thickness between approximately 50 and 300 micrometers. It should be noted that other ceramic coatings that prevent bonding between the coulomb damper insert 18 and the casting material 39 and having a melting point higher than that of the casting material 39 may be used. Additionally, non-ceramic coatings such as those with hydrocarbon based carriers may be used while remaining within the scope of that which is claimed. Furthermore, a coating may not be required should the intrinsic properties of the material forming the coulomb damper insert 18 allow the coulomb damper insert 18 to remain substantially non-bonded with the casting material 39 thereby providing a proper interfacial boundary with the casting material 39 for damping.

Figure 1D:
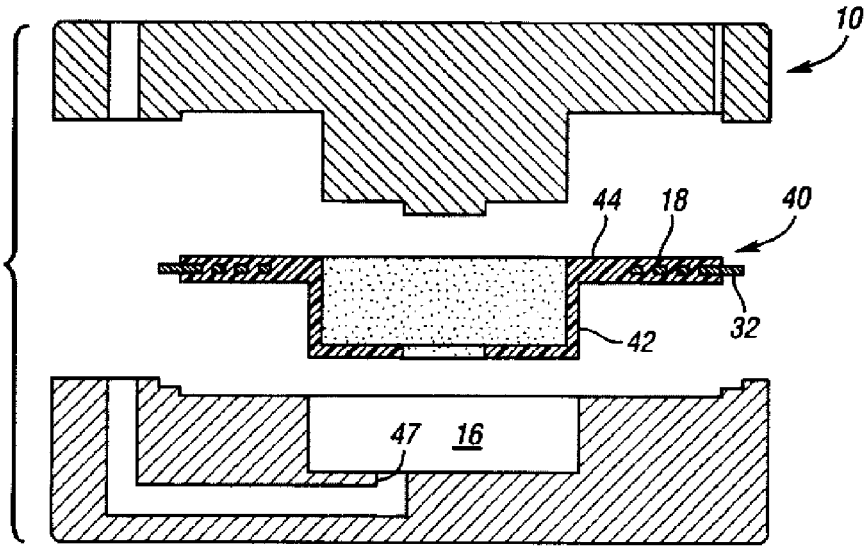
FIG. 1*d* is a schematic cross sectional side view of the mold of FIG. 1*a*, with the mold opened and the coulomb damped disc brake rotor ejected from the mold in accordance with the invention.

Referring to FIG. 1*d*, the mold 10 is shown in the open position with the friction damped disc brake rotor 40 removed from the mold cavity 16. As shown, the coulomb damped disc brake rotor 40 has a hat portion 42 with the rotor cheek 44 extending about the periphery thereof, and the coulomb damper insert 18 positioned within the rotor cheek 44. The distal end 32 of each of the tabs 20 of the coulomb damper insert 18 is removed, such as by machining, after the coulomb damped disc brake rotor 40 is removed from the mold 10.

The locating tabs 20 may be formed on the inside diameter (i.e. radially inwardly extending), outside diameter (i.e. radially outwardly extending), or both to locate and stabilize the coulomb damper insert 18 during the casting operation. The number and placement of tabs 20 will depend, in part, on the specific rotor cheek 44 geometry and dimensions, and on the thickness of the coulomb damper insert 18. Alternately, the coulomb damper insert 18 may be formed without tabs 20 such that the coulomb damper insert 18 is self supporting or fixturing within the mold 10.

The coulomb damper insert 18 is preferably 1.5 to 2 mm in thickness, but other thicknesses are envisioned. The thickness of the coulomb damper insert 18 is chosen to prevent bending or flexing of the coulomb damper insert 18 while not being so thick as to "chill" the surrounding molten casting material 39 during casting.

The location, number, and geometry of the holes 35 within the coulomb damper insert 18 are preferably chosen such that mold filling is facilitated while reducing the tendency of the casting material 39 to move or dislodge the coulomb damper insert 18 during the casting operation. In other words, the holes 35 help to prevent molten casting material 39 from lifting or shifting the coulomb damper insert 18, as the mold 10 is filled from below through the gate 47, shown in FIG. 1*c*. By gating below the part and using the horizontally parted mold 10, the molten casting material 39 is not directed or splashed onto the coulomb damper insert 18 prematurely. Also, quiescent mold filling prevents splashing and premature solidification of droplets of molten casting material 39 on the coulomb damper insert 18 prior to general contact with molten casting material 39 during filling of the mold 10. Further, the molten casting material 39 is preferably filtered at the gate 47 with a ceramic filter, not shown, to reduce slag related defects. Although a generally horizontally parted mold 10 has been described hereinabove, those skilled in the art of casting will recognize that vertically parted molds may be utilized to form the coulomb damped disc brake rotor 40 of the present invention with the casting process determined by such aspects as casting volume, mold footprint, etc. Additionally various additional gating techniques may be envisioned while remaining within the scope of that which is claimed. Additionally, the location, number and geometry of the holes 35 within the coulomb damper insert 18 may also be chosen to increase damping effectiveness.

Figure 2:
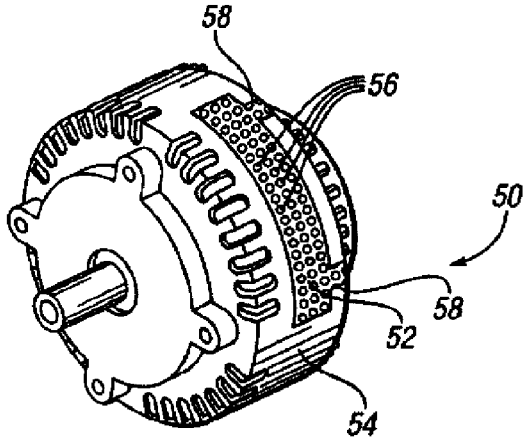
FIG. 2 shows a schematic perspective view of an electric drive motor housing having a cast in place coulomb damper insert in accordance with the invention.

Other automotive components, in addition to the coulomb damped disc brake rotor 40, may be formed using the same general method outlined above with reference to FIGS. 1*a* through 1*d*. Referring to FIG. 2, a schematic perspective view of an electric drive motor housing 50 is shown having a coulomb damper insert 52 which is cast into a peripheral wall 54 of the electric drive motor housing 50 in accordance with the invention. The coulomb damper insert 52 defines a plurality of orifices or holes 56 and is prepared in a manner such that the surface of the coulomb damper insert 52 is not bonded to the casting material during casting. The preparation coating the coulomb damper insert, as described hereinabove, prior to casting the drive motor housing 50 to provide proper boundary interface between the coulomb damper insert 52 and the wall 54 to prevent bonding of the coulomb damper insert 52 with the wall 54. Alternately the intrinsic properties of the material forming the coulomb damper insert 52 may substantially prevent bonding between the coulomb damper insert 52 and the wall 54. The coulomb damper insert 52 may be provided with peripheral tabs 58 to support the coulomb damper insert 52 in a suspended position within a mold cavity for casting. As described hereinabove, the tabs 58 are preferably prepared in a manner to enhance bonding between the tabs 58 and the wall 54 to prevent unwanted corrosion causing elements from reaching the interfacial boundary between the coulomb damper insert 52 and the wall 54. Those skilled in the art will recognize that the tabs 58 can be omitted in instances where the coulomb damper insert 52 is self supporting or fixturing within the mold.

As with the coulomb damper insert 18, the coulomb damper insert 52 is preferably pre-manufactured from steel, aluminum, magnesium, or other suitable material. The coulomb damper insert 52 may comprise any material having a melting point higher than that of cast alloy that would not be melted during the casting process. Typical materials suitable for forming the coulomb damper insert 52 are steel or stainless steel for castings formed from grey iron. Alternatively, pure aluminium, dilute aluminium alloys, and steel may be used to form the coulomb damper insert 52 for casting formed from aluminium. It may be beneficial and/or desirable to match the thermal expansion coefficient of the coulomb damper insert 52 with that of the wall 54 to minimize thermally induced stresses in service. In addition to the tabs 58, those skilled in the art will recognize that other portions of the coulomb damper insert 52 may be left uncoated to promote bonding depending on the damping requirements of the component while remaining within the scope of that which is claimed.

Figure 3:
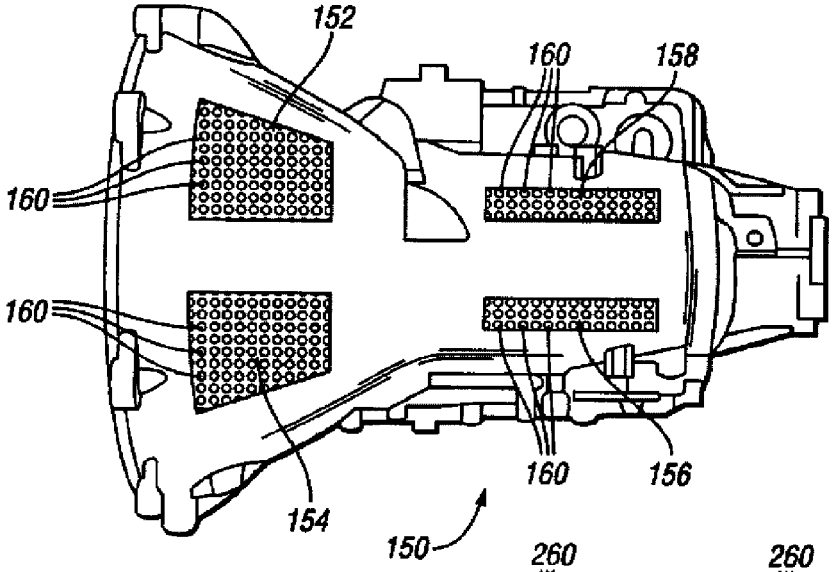
FIG. 3 shows a schematic perspective view of a transmission housing having cast in place coulomb damper inserts in accordance with the invention.

FIG. 3 shows a schematic perspective view of a transmission housing 150 having coulomb damper inserts 152, 154, 156, and 158 cast in place in accordance with the invention. Each of the coulomb damper inserts 152, 154, 156, and 158 define a plurality of holes 160.

Figure 4:
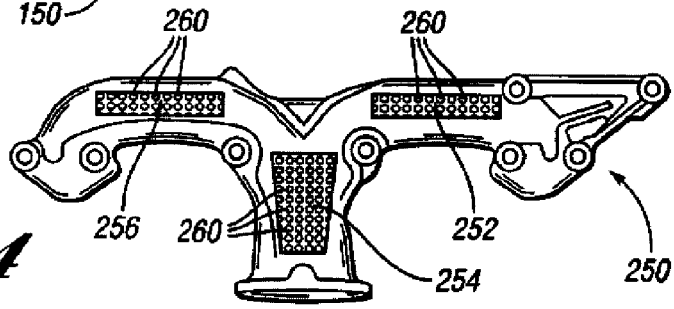
FIG. 4 shows a schematic perspective view of an exhaust manifold having cast in place coulomb damper inserts in accordance with the invention.

FIG. 4 shows a schematic perspective view of an exhaust manifold 250 having coulomb damper inserts 252, 254, and 256 cast in accordance with the invention. The inserts 252, 256 are curved, and the insert 254 partially conical. Each of the coulomb damper inserts 252, 254, and 256 define a plurality of holes 260.

Figure 5:
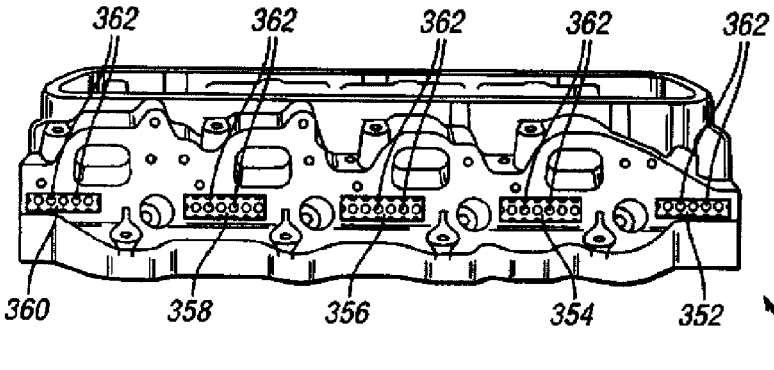
FIG. 5 shows a schematic perspective view of a cylinder head having cast in place coulomb damper inserts in accordance with the invention.

FIG. 5 shows a schematic perspective view of a cylinder head 350 having coulomb damper inserts 352, 354, 356, 358, and 360 cast in place in accordance with the invention. Each of the coulomb damper inserts 352, 354, 356, 358, and 360 define a plurality of holes 362.

Figure 6:
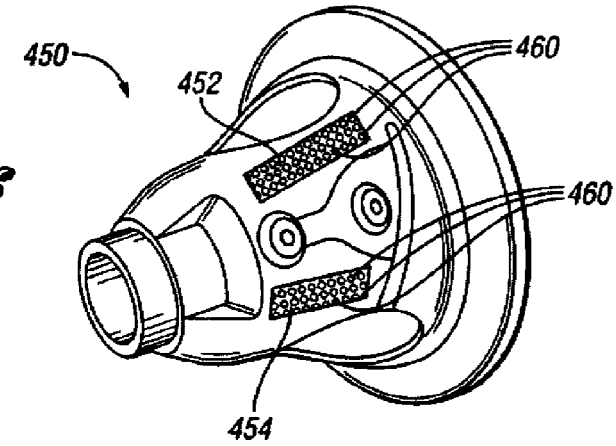
FIG. 6 shows a schematic perspective view of a differential case having cast in place coulomb damper inserts in accordance with the invention.

FIG. 6 shows a schematic perspective view of a differential case 450 having coulomb damper inserts 452 and 454 cast in place in accordance with the invention. Each of the coulomb damper inserts 452 and 454 define a plurality of holes 460.

Figure 7:
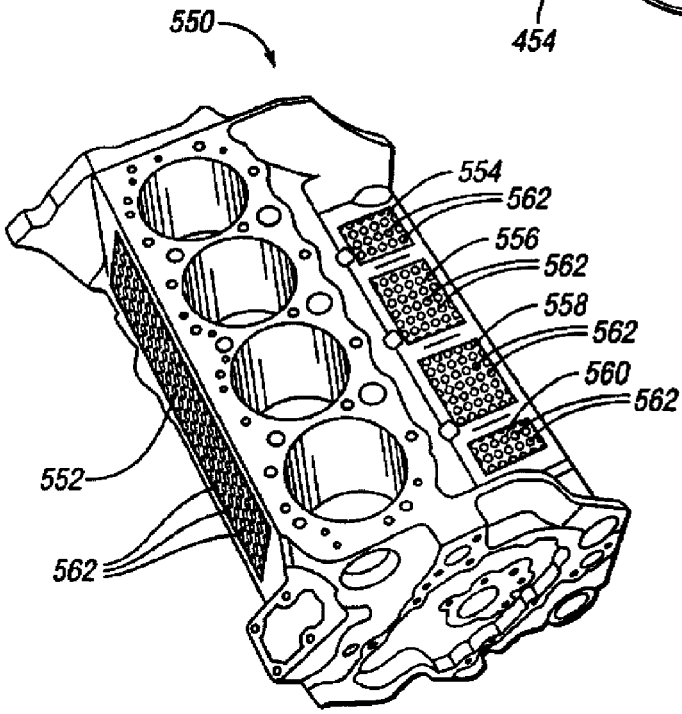
FIG. 7 shows a schematic perspective view of an engine block having cast in place coulomb damper inserts in accordance with the invention.

FIG. 7 shows a schematic perspective view of an engine block 550 having coulomb damper inserts 552, 554, 556, 558 and 560 cast in place in accordance with the invention. Each of the coulomb damper inserts 552, 554, 556, 558 and 560 define a plurality of holes 562.

Figure 8:
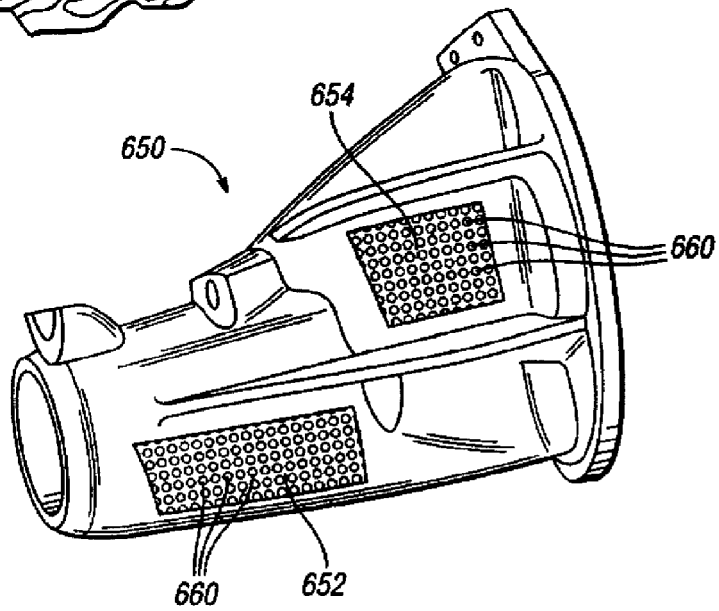
FIG. 8 shows a schematic perspective view of a rear end housing having cast in place coulomb damper inserts in accordance with the invention.

FIG. 8 shows a schematic perspective view of a rear end housing 650 having coulomb damper inserts 652 and 654 cast in place in accordance with the invention. Each of the coulomb damper inserts 652 and 654 defines a plurality of holes 660.

Locating tabs are not shown in FIGS. 2 through 8, but may be used to position and to stabilize the coulomb damper insert during the metal casting operation. Alternately, the coulomb damper insert may be positioned within the casting cavity of the mold in a manner without tabs when the coulomb damper insert is self supporting or fixturing. As a further alternative embodiment, the above-described coated inserts may be provided in a structural oil pan.

By providing holes or orifices within the coulomb damper inserts, the interfacial surface area per unit mass is increased, when the walls of the holes are coated, compared to inserts with no holes, thereby increasing the damping effectiveness with a reduction in weight. Additionally, the holes reduce the likelihood of distorting the coulomb damper insert during casting, thereby allowing thinner cross sections to be cast while still achieving complete encapsulation of the coulomb damper insert. Additional damping effectiveness may be obtained due to the three-dimensional nature of the coulomb damper insert of the present invention. The holes or orifices defined by the insert of the present invention may facilitate the casting of thin-walled castings that would be excessively chilled with a solid insert. Furthermore, the holes or orifices defined by the coulomb damper insert allow continuous paths to be maintained throughout the wall of the casting, thereby acting to improve the mechanical strength and properties of the cast wall having the coulomb damper insert embedded or encapsulated therein. Consequently, the insert defining a plurality of holes may generally be employed to maintain the mechanical properties of thin walled castings, whereas the mechanical properties for thin walled castings may be compromised by the inclusion of a coulomb damper insert having a large and continuous surface area forming large planes of non-bonded material. Additionally, the coulomb damper insert of the present invention may reduce the casting defect scrap rate due to the reduced chance of casting cracks at the insert location. Similarly, the likelihood of cracking during machining operations and use is also reduced.

To those skilled in the art to which this invention pertains, the above described preferred embodiments may be subject to change or modification. Such change or modification can be carried out without departing from the scope of the invention, which is intended to be limited only by the scope of the appended claims.

The invention claimed is:

1. A method for manufacturing an automotive component member, comprising:

positioning at least one insert into a mold, wherein said at least one insert defines a plurality of holes; and casting a portion of the automotive component member in said mold to substantially encapsulate said at least one insert such that a major portion of said at least one insert is substantially non-bonded with casting material to provide a proper interfacial boundary with the casting material for damping.

2. The method of claim 1, further comprising coating said at least one insert to prevent bonding between said at least one insert and the casting material.

3. The method of claim 1, wherein the automotive component member comprises an electric drive motor housing.

4. The method of claim 1 wherein the automotive component member comprises a transmission housing.

5. The method of claim 1, wherein the automotive component member comprises a rear end housing.

6. The method of claim 1, wherein the automotive component member comprises an engine block.

7. The method of claim 1, wherein the automotive component member comprises a differential case.

8. The method of claim 1, wherein the automotive component member comprises an exhaust manifold.

9. The method of claim 1, wherein the automotive component member comprises a cylinder head.

10. The method of claim 1, wherein the automotive component member comprises a disc brake rotor.

11. A method as set forth in claim 1, wherein portions of the insert defining the plurality of holes is non-bonded to the casting material.

12. A method for manufacturing a damped automotive component member, comprising:

positioning at least one insert into a mold, wherein said at least one insert defines a plurality of holes; and casting a portion of the automotive component member in said mold to substantially encapsulate said at least one insert such that a major portion of said at least one insert is substantially non-bonded with the casting material to provide a proper interfacial boundary with the casting material for damping, wherein said at least one insert is provided with at least one tab to support said at least one insert within said mold for said casting.

13. The method of claim 12, further comprising coating said at least one insert to substantially prevent bonding between said at least one insert and the casting material.

14. A method as set forth in claim 13, wherein the coating is performed so that portions of the insert defining the plurality of holes is non-bonded with the casting material.

* * * * *